US007242366B2

(12) United States Patent
Shibata

(10) Patent No.: US 7,242,366 B2
(45) Date of Patent: Jul. 10, 2007

(54) ANTENNA APPARATUS

(75) Inventor: Osamu Shibata, Kawasaki (JP)

(73) Assignee: Murata Manufacturing Co., Ltd (JP)

( * ) Notice: Subject to any disclaimer, the term of this patent is extended or adjusted under 35 U.S.C. 154(b) by 0 days.

(21) Appl. No.: 11/523,703

(22) Filed: Sep. 20, 2006

(65) Prior Publication Data

US 2007/0030210 A1 Feb. 8, 2007

Related U.S. Application Data

(63) Continuation of application No. PCT/JP2005/015402, filed on Aug. 25, 2005.

(30) Foreign Application Priority Data

Sep. 3, 2004 (JP) ..... 2004-257379

(51) Int. Cl.
*H01Q 21/00* (2006.01)

(52) U.S. Cl. ..... 343/893; 343/833

(58) Field of Classification Search ..... 343/833, 343/834, 893, 815, 702
See application file for complete search history.

(56) References Cited

U.S. PATENT DOCUMENTS

| | | | | |
|---|---|---|---|---|
| 4,334,230 | A * | 6/1982 | Kane | 343/797 |
| 5,926,750 | A * | 7/1999 | Ishii | 455/130 |
| 6,233,434 | B1 * | 5/2001 | Takei | 455/103 |
| 6,774,863 | B2 * | 8/2004 | Shirosaka et al. | 343/797 |
| 6,831,611 | B2 * | 12/2004 | Ooe et al. | 343/713 |

FOREIGN PATENT DOCUMENTS

| | | |
|---|---|---|
| JP | 49-32239 | 8/1974 |
| JP | 62-198706 | 12/1987 |
| JP | 63-100387 | 5/1988 |
| JP | 09-139626 | 5/1997 |
| JP | 2001-024431 | 1/2001 |
| JP | 2002-016427 | 1/2002 |
| JP | 2002-016432 | 1/2002 |
| JP | 2004-221971 | 8/2004 |

OTHER PUBLICATIONS

International Search Report dated Nov. 15, 2005 (w/ English translation).
Written Opinion dated Nov. 15, 2005 (w/ English translation).
Ohira et al., Electronically Steerable Parasitic Array Radiator Antenna, Jan. 2004 vol. J87-C No. 1.

* cited by examiner

*Primary Examiner*—Trinh Dinh
*Assistant Examiner*—Huedung Mancuso
(74) *Attorney, Agent, or Firm*—Dickstein, Shapiro, LLP.

(57) ABSTRACT

An antenna apparatus including a feed element excited by first and second wireless frequency signals, first non-feed elements for controlling directivity with respect to the first wireless frequency signal, second non-feed elements for controlling directivity with respect to the second wireless frequency signal, second variable-reactance circuits disposed between the second non-feed elements and ground, filters for passing the first frequency band and cutting off the second frequency band, which are connected to the first non-feed elements, and first variable-reactance circuits disposed between the filters and the ground.

19 Claims, 7 Drawing Sheets

(A)

(B)

(A)

(B)

(A)

(B)

(A)

(B)

(A)

(B)

(A)

(B)

ANTENNA APPARATUS

CROSS REFERENCE TO RELATED APPLICATIONS

The present application is a continuation of International Application No. PCT/JP2005-015402, filed Aug. 25, 2005, which claims priority to Japanese Patent Application No. JP2004-257379, filed Sep. 3, 2004, the entire contents of each of these applications being incorporated herein by reference in their entirety.

FIELD OF THE INVENTION

The present invention relates to directivity-controllable antenna apparatuses for use in, for example, wireless LANs or the like.

BACKGROUND OF THE INVENTION

ESPAR (Electronically Steerable Passive Array Radiator) antennas including a plurality of non-feed elements to which variable-reactance circuits are connected and a single feed element have been developed as variable-directivity antennas (for example, see Non-Patent Document 1 and Patent Documents 1–3).

Referring to FIG. 7, a known ESPAR antenna will be described.

FIG. 7(A) is a perspective view of main portions of an antenna apparatus, and FIG. 7(B) is a side view of the main portions. The antenna apparatus includes a ground conductor 1, a feed element 60 disposed at the central part of the ground conductor 1, and a plurality of non-feed elements 61*a* to 61*f* disposed around the feed element 60. Variable-reactance circuits including varactor diodes are disposed between these non-feed elements 61*a* to 61*f* and the ground. FIG. 7(B) shows the non-feed elements 61*b* and 61*e* to which variable-reactance circuits 62*b* and 62*e* are connected. A feeder circuit 30 is connected to the feed element 60.

The case in which radio waves are transmitted from the antenna apparatus, that is, the case in which power is supplied from the feeder circuit 30 to the feed element 60, will be examined. In the antenna apparatus with the above-described structure, electromagnetic coupling between the feed element 60 at the center and the peripheral non-feed elements 61*a* to 61*f* is actively employed. The radiation directivity (radiation pattern) of radio waves transmitted from the antenna apparatus is determined by the state of the electromagnetic coupling. When the reactances of the variable-reactance circuits connected to the peripheral non-feed elements 61*a* to 61*f* change, so does the state of the electromagnetic coupling. As a result, the radiation directivity of the antenna apparatus changes.

For example, as shown in FIG. 7, the feed element 60, which is a monopole antenna, is disposed at the center of the disc-shaped ground conductor 1, and, about one-quarter wavelength from the feed element 60, the non-feed elements 61*a* to 61*f* including six monopole antennas are circularly disposed at intervals of 60 degrees. Varactor diodes are used as the variable-reactance circuits. By appropriately setting voltages applied to the varactor diodes, the radiation directivity of the antenna apparatus in a horizontal plane can be controlled.

A multi-channel antenna apparatus for reducing an effect of coupling among element antennas excited at different frequencies, which is caused by the element antennas being disposed in the same aperture, is described in Patent Document 4. Non-Patent Document 1: Takashi Ohira and Kyouichi Iigusa, "Denshi-sousa Douhaki Array Antenna (Electronic Scanning Waveguide Array Antenna)", IEICE Trans. C, Vol. J87-C, No. 1, January 2004, pp. 12–31

Patent Document 1: Japanese Unexamined Patent Application Publication No. 2002-16427

Patent Document 2: Japanese Unexamined Patent Application Publication No. 2001-24431

Patent Document 3: Japanese Unexamined Patent Application Publication No. 2002-16432

Patent Document 4: Japanese Unexamined Patent Application Publication No. 9-139626

A plurality of different frequency bands may be used by devices or systems used for the same purpose. For example, the standards for wireless LANs include the IEEE 802.11a using the 5.2 GHz band and the IEEE 802.11b/g using the 2.4 GHz band. To configure an access point covering both frequency bands, a single antenna that covers these two frequency bands is necessary.

However, the ESPAR antennas described in Non-Patent Document 1 and Patent Documents 1 to 3 are used in only one frequency band and are not intended to be used in a plurality of frequency bands at the same time or at different times.

Regarding the antenna apparatus described in Patent Document 4, active directivity control, such as that performed by non-feed elements in an ESPAR antenna, cannot be performed in a plurality of frequency bands.

Conceivably, an antenna apparatus covering a plurality of frequency bands may be configured by disposing a plurality of ESPAR antennas, each operating as an ESPAR antenna in one frequency band, on a single ground conductor. However, the directivity of an ESPAR antenna changes due to electromagnetic coupling between a feed element (radiating element or radiator) and non-feed elements (waveguide elements or directors). When feed elements and non-feed elements operating in a plurality of frequency bands are simply disposed on the same ground conductor, the radiation directivity in a desired frequency band is negatively affected by coupling between a feed element and non-feed elements in an undesired frequency band. As a result, the desired radiation directivity cannot be achieved.

Problems similar to those above occur when the radiation directivity with respect to wireless frequency signals in different frequency bands is controlled or when the feeding position in the structure of a diversity antenna is changed.

SUMMARY OF THE INVENTION

Accordingly, it is an object of the present invention to provide an antenna apparatus whose directivity can be controlled in a plurality of frequency bands.

An antenna apparatus according to a first preferred embodiment of the present invention includes a feed element excited by a first wireless frequency signal in a first frequency band and a second wireless frequency signal in a second frequency band higher than the first frequency band; a first non-feed element for controlling directivity with respect to the first wireless frequency signal; a second non-feed element for controlling directivity with respect to the second wireless frequency signal; a filter for passing the first frequency band and cutting off the second frequency band, one end of the filter being connected to the first non-feed element; a first variable-reactance circuit connected between the other end of the filter and ground; and a second variable-reactance circuit connected between the second non-feed element and the ground.

An antenna apparatus according to a second preferred embodiment of the present invention includes a first feed element excited by a first wireless frequency signal in a first frequency band; a second feed element excited by a second wireless frequency signal in a second frequency band higher than the first frequency band; a first non-feed element for controlling directivity with respect to the first wireless frequency signal; a second non-feed element for controlling directivity with respect to the second wireless frequency signal; a filter for passing the first frequency band and cutting off the second frequency band, one end of the filter being connected to the first non-feed element; a first variable-reactance circuit connected between the other end of the filter and ground; and a second variable-reactance circuit connected between the second non-feed element and the ground.

An antenna apparatus according to a third preferred embodiment of the present invention includes a plurality of first feed elements excited by a first wireless frequency signal in a first frequency band; a second feed element excited by a second wireless frequency signal in a second frequency band higher than the first frequency band; a second non-feed element for controlling directivity with respect to the second wireless frequency signal; a variable-reactance circuit connected between the second non-feed element and ground; a filter for passing the first frequency band and cutting off the second frequency band, one end of the filter being connected to the first feed elements; and a switching circuit connected between the other end of the filter and a feeder circuit for feeding the first wireless frequency signal.

According to the first preferred embodiment of the invention, with the feed element excited by the first wireless frequency signal in the first frequency band and the second wireless frequency signal in the second frequency band higher than the first frequency band and with the first non-feed element, the radiation directivity (radiation pattern) with respect to the first wireless frequency signal is controlled in accordance with the control of reactance of the first variable-reactance circuit. With the feed element and the second non-feed element, the radiation directivity with respect to the second wireless frequency signal is controlled in accordance with the control of the reactance of the second variable-reactance circuit. Since the filter connected to the first non-feed element passes the first wireless frequency signal and cuts off the second wireless frequency signal, the terminal condition of the first non-feed element (element for lower frequencies) with respect to the second wireless frequency signal changes negligibly, thereby reducing an effect of the first non-feed element (element for lower frequencies) on the radiation directivity with respect to the second wireless frequency signal. In contrast, when the second non-feed element (element for higher frequencies) is designed to be excited in a generally used basic mode, an effect of the second feed element on the radiation directivity with respect to the first wireless frequency signal is small since the electromagnetic field excited at lower frequencies is generally small. As a result, desired radiation directivities can be achieved independently with respect to the first and second wireless frequency signals respectively.

According to the second preferred embodiment of the invention, with the first feed element excited by the first wireless frequency signal and the second feed element excited by the second wireless frequency signal, the antenna apparatus can be directly applied to the case in which a feeder circuit for the first wireless frequency signal and a feeder circuit for the second wireless frequency signal are independent of each other. Advantages obtained from the combination of the first and second non-feed elements, the first and second variable-reactance circuits connected thereto, and the filter are similar to those of the first preferred embodiment.

According to the third preferred embodiment of the invention, with the second feed element, the second non-feed element, and the variable-reactance circuit, the radiation directivity with respect to the second wireless frequency signal can be controlled. Since the filter for passing the first wireless frequency signal and cutting off the second wireless frequency signal is provided between the plurality of first feed elements and the ground, no negative effect is exerted by the plurality of first non-feed elements on the control of the radiation directivity with respect to the second wireless frequency signal using the variable-reactance circuit connected to the second non-feed element. With regard to the first wireless frequency signal, the antenna apparatus operates as a diversity antenna when switching is performed by the switching circuit.

REFERENCE NUMERALS

Figure 1:
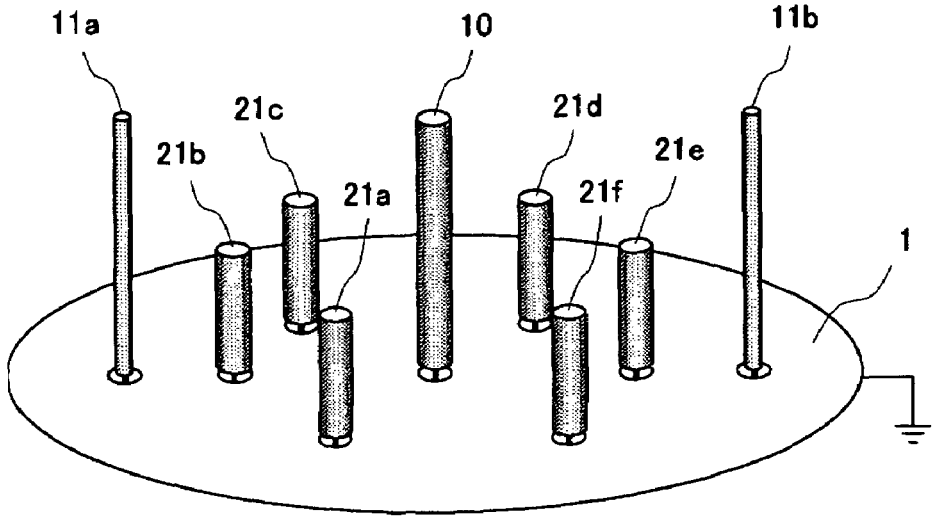
FIG. 1(A) is a perspective view and FIG. 1(B) is a side view of main portions of an antenna apparatus according to a first embodiment.
Figure 1:
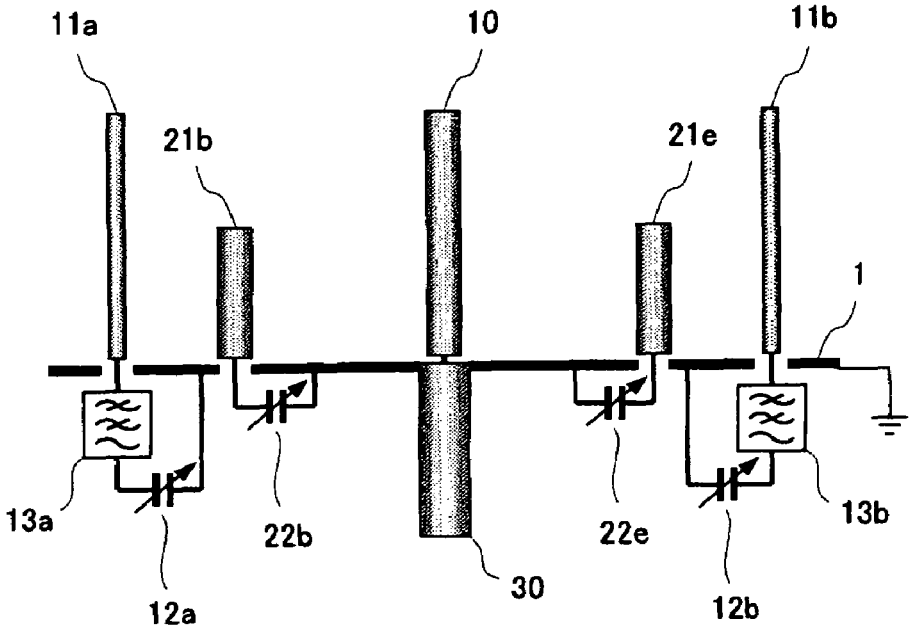

1: ground conductor
10 and 10': feed elements (first feed elements)
11: first non-feed elements
12: first variable-reactance circuits
13: filters
14: filters
20: second feed element
21: second non-feed elements (non-feed elements)
22: second variable-reactance circuits (variable-reactance circuits)
30: feeder circuit
31: first feeder circuit
32: second feeder circuit
4: antenna switching circuit
50: matching short-circuit posts
60: feed element
61: non-feed elements
62: variable-reactance circuits

DETAILED DESCRIPTION OF THE INVENTION

Figure 2:
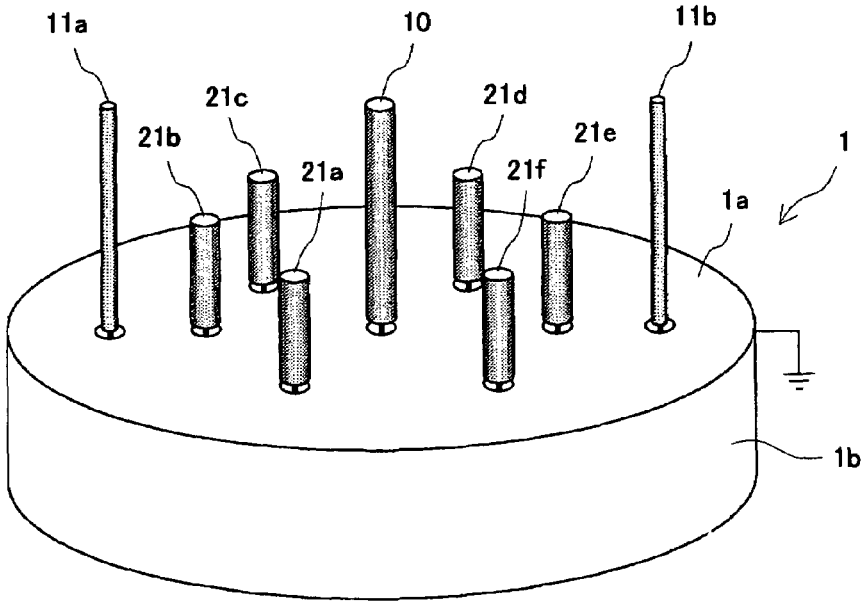
FIG. 2(A) is a perspective view and FIG. 2(B) is a side view of main portions of an antenna apparatus with a different structure according to the first embodiment.
Figure 2:
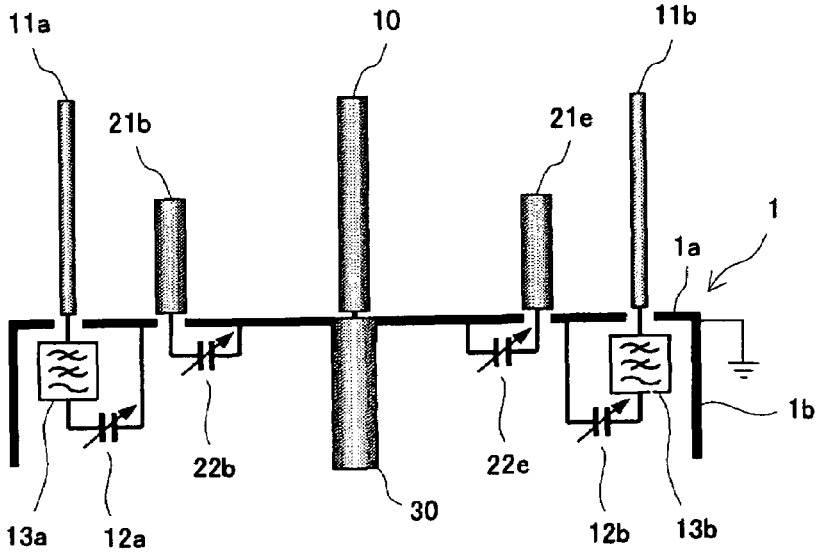

With reference to FIGS. 1 and 2, an antenna apparatus according to a first embodiment will be described. The antenna apparatus is applied to a first wireless frequency signal (a signal in accordance with the IEEE 802.11b/g standards) in 2.4 GHz band serving as a first frequency band and a second wireless frequency signal (a signal in accordance with the IEEE 802.11a) in 5.2 GHz band serving as a second frequency band.

FIG. 1(A) is a perspective view of main portions of an antenna apparatus, and FIG. 1(B) is a side view of the main portions of the antenna apparatus. A feed element 10 including a monopole antenna is disposed at the central part of a disc-shaped grounded ground conductor 1. First non-feed elements 11*a* and 11*b* are disposed on the left and right sides in the drawings of the feed element 10. Six second non-feed elements 21*a* to 21*f* are circularly disposed around the feed element 10.

The first non-feed elements 11*a* and 11*b* are disposed at positions on the left and right sides of the feed element 10, at about one-quarter to one-half wavelength in the first frequency band (2.4 GHz band) from the feed element 10. The second non-feed elements 21*a* to 21*f* are circularly disposed at intervals of 60 degrees, at about one-quarter to one-half wavelength in the second frequency band (5.2 GHz band) from the feed element 10.

A feeder circuit 30 for supplying power to the feed element 10 at the center is disposed below the feed element 10 on the bottom side of the ground conductor 1, as shown in portion (B) of FIG. 1. Filters 13*a* and 13*b* for passing the first frequency band (2.4 GHz band) and cutting off the second frequency band (5.2 GHz band) are connected to associated ends of the first non-feed elements 11*a* and 11*b*. First variable-reactance circuits 12*a* and 12*b* are connected between other ends of the filters 13*a* and 13*b* and the ground. Second variable-reactance circuits are disposed between the six second non-feed elements 21*a* to 21*f* and the ground.

In FIG. 1(B), only the second non-feed elements 21*b* and 21*e* are shown in order to simplify the drawing. Accordingly, only the second variable-reactance circuits 22*b* and 22*e* connected between the second non-feed elements 21*b* and 21*e* and the ground are shown.

The ground conductor 1 is fabricated by forming a conductive film or a conductive layer on top of or in the middle of a dielectric laminated body formed of, for example, FR-4 or Teflon (registered trademark) fiber. The first and second variable-reactance circuits each include a variable capacitance element, such as a varactor diode, whose reactance changes with applied voltage and a circuit for applying a control voltage to the variable capacitance element.

The electrical lengths between the first non-feed elements 11*a* and 11*b* for lower frequencies and the filters 13*a* and 13*b* are set to appropriate values so that the first non-feed elements 11*a* and 11*b* for lower frequencies are not excited in the second frequency band (5.2 GHz band). Depending on the input impedance of a filter in the 5.2 GHz band, it is generally preferable that the filters 13*a* and 13*b* be disposed in the vicinity of the first non-feed elements 11*a* and 11*b*.

Advantages of the antenna apparatus with the above-described structure are as follows.

By controlling the reactances of the second variable-reactance circuits 22 connected to the second non-feed elements 21*a* to 21*f* for higher frequencies, the radiation directivity in a horizontal plane (in the direction of the surface of the ground conductor 1) with respect to the second wireless frequency signal (a signal in 5.2 GHz band in accordance with the IEEE 802.11a standard) can be controlled. Similarly, by controlling the reactances of the first variable-reactance circuits 12*a* and 12*b* for lower frequencies, the radiation directivity in the horizontal plane with respect to the first wireless frequency signal (a signal in the 2.4 GHz band in accordance with the IEEE 802.11b/g standards) can be controlled.

Since the filters 13*a* and 13*b* for passing the first frequency band and cutting off the second frequency band are disposed between the first non-feed elements 11*a* and 11*b* for lower frequencies and the first variable-reactance circuits 12*a* and 12*b*, even when the reactances of the first variable-reactance circuits 12*a* and 12*b* are changed to control the radiation directivity with respect to the first wireless frequency signal, no significant effect is exerted on electromagnetic coupling between the feed element 10 and the second non-feed elements 21*a* to 21*f* in the second frequency band (5.2 GHz band). Therefore, no negative effects are produced on the radiation directivity with respect to the second wireless frequency signal.

The second non-feed elements 21*a* to 21*f* for higher frequencies are not provided with filters for cutting off the first frequency band serving as lower frequencies. The second non-feed elements 21*a* to 21*f* for higher frequencies only need to be designed with specific lengths or the like so that they are excited in a basic mode. For example, the second non-feed elements 21*a* to 21*f* are monopole antennas with about one-quarter wavelength in the second frequency band (5.2 GHz band). With this structure, the second non-feed elements 21*a* to 21*f* are negligibly excited by the first wireless frequency signal. Therefore, the second non-feed elements 21*a* to 21*f* have almost no negative effects on the radiation directivity with respect to the first wireless frequency signal serving as lower frequencies.

Accordingly, the radiation directivity can be controlled independently with respect to the first wireless frequency signal and the second wireless frequency signal.

In the example shown in FIG. 1, the spacing between the feed element 10 and each of the non-feed elements 11*a* and 11*b* and 21*a* to 21*f* is about one-quarter to one-half wavelength. Alternatively, the non-feed elements 11*a* and 11*b* and 21*a* to 21*f* may be disposed at arbitrary positions within about one wavelength in the operating frequency band from the feed element 10. The number of non-feed elements is not limited to that shown in FIG. 1. The variable-reactance circuits are not limited to those including varactor diodes and may be circuits in which a fixed reactance is changed using a switch or the like. The filters may be band-pass SAW filters, low-pass filters including chip inductors and capacitances, or the like.

FIG. 2 shows an antenna apparatus with a structure different from that of FIG. 1. FIG. 2(A) is a perspective view of an antenna apparatus, and FIG. 2(B) is a cross section, viewed from the side, of a central part of the antenna apparatus.

In the example shown in FIG. 1, the disc-shaped ground conductor 1 is used. In the antenna apparatus shown in FIG. 2, the ground conductor 1 includes a disc-shaped portion 1*a* and a cylindrical portion (skirt) 1*b* extending downward from the periphery of the disc-shaped portion 1*a*. This corresponds to a portion formed by bending downward the periphery of the disc-shaped ground conductor, which is one size larger than a region in which the feed element 10, the first non-feed elements 11*a* and 11*b*, and the second non-feed elements 21*a* to 21*f* are disposed. The other portions of the structure are the same as those shown in FIG. 1.

By extending the periphery of the ground conductor 1 in a direction opposite to that in which the feed element and the non-feed elements protrude, advantages substantially similar to those achieved by increasing the area of the ground conductor 1 can be achieved without increasing the overall size, and the directivity of the antenna can be improved.

Figure 3:
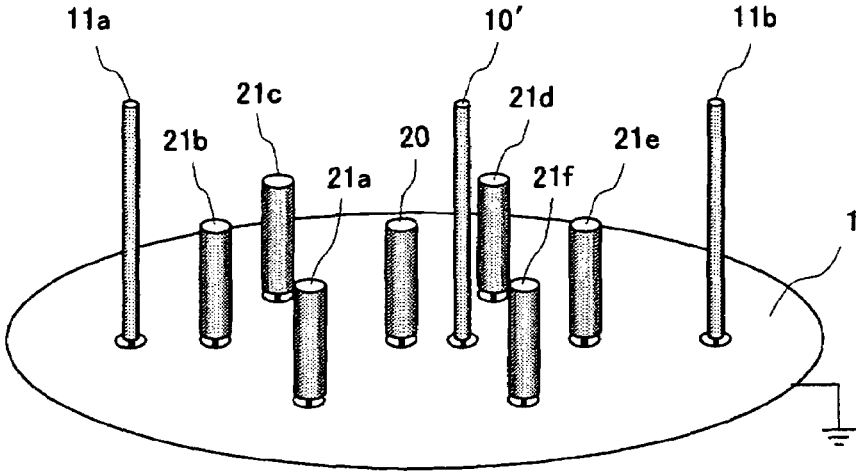
FIG. 3(A) is a perspective view and FIG. 3(B) is a side view of main portions of an antenna apparatus according to a second embodiment.
Figure 3:
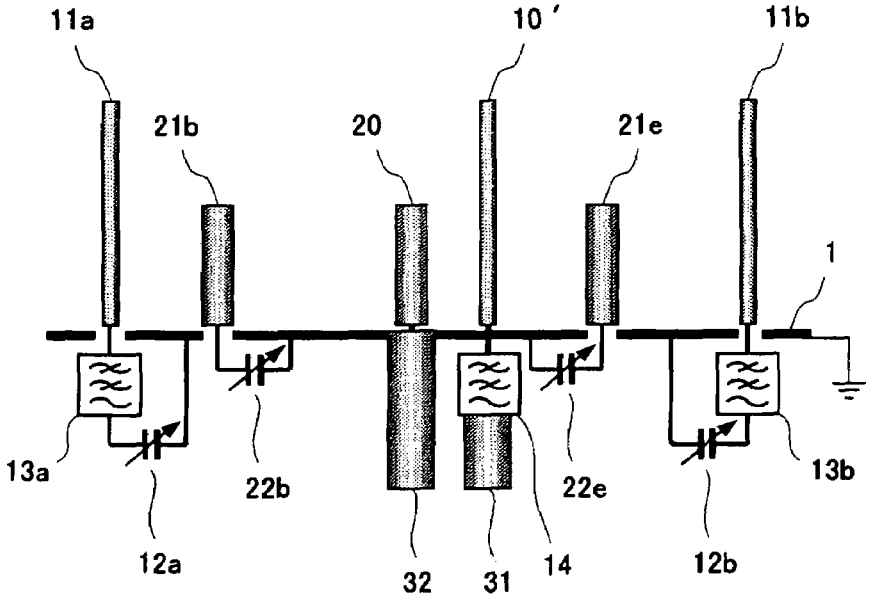

Referring to FIG. 3, an antenna apparatus according to a second embodiment will be described.

In the first embodiment, the first and second wireless frequency signals are supplied to the single feed element 10. In the second embodiment, a first feed element 10 that is excited by the first wireless frequency signal (a signal in accordance with the IEEE 802.11b/g standards) in the first frequency band (2.4 GHz band) and a second feed element 20 that is excited by the second wireless frequency signal (a signal in accordance with the IEEE 802.11a standard) in the second frequency band (5.2 GHz band) are individually provided. Accordingly, a first feeder circuit 31 corresponding to the first feed element 10' and a second feeder circuit 32 corresponding to the second feed element 20 are provided. Since the first and second feed elements 10' and 20 are separate from each other, the second embodiment can be directly applied to the first and second feeder circuits 31 and 32 independently provided.

In the second embodiment, a filter 14 for passing the first frequency band and cutting off the second frequency band is provided between the first feed element 10' and the first feeder circuit 31. As a result, the radiation directivity with respect to the second wireless frequency signal is not negatively affected by whether the first wireless frequency signal is supplied by the first feeder circuit 31.

In contrast, by determining the length or the like of the second feed element 20 so that the second feed element 20 is excited in a basic mode, the second feed element 20 is negligibly excited by the first feed element 10' for lower frequencies, and hence the radiation directivity with respect to the first wireless frequency signal is not negatively affected by the presence of the second feed element 20.

In this example, the filter 14 for passing the first frequency band and cutting off the second frequency band is inserted between the first feeder circuit 31 and the first feed element 10'. However, since coupling between the first feed element 10' and the peripheral second non-feed elements 21 is small, the radiation directivity with respect to the second wireless frequency signal is not significantly affected by the feeding state of the first feeder circuit 31. Therefore, the filter 14 is not essential.

Figure 4:
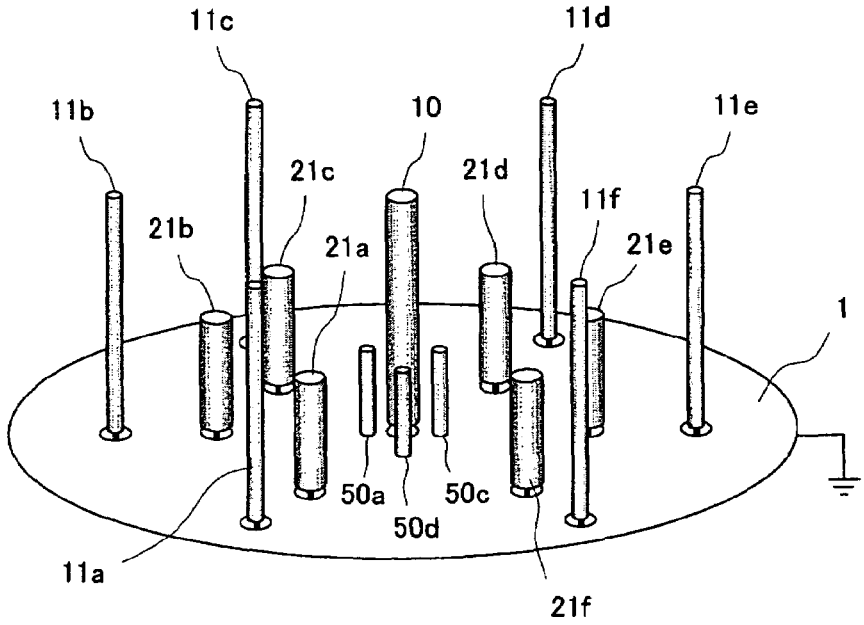
FIG. 4(A) is a perspective view and FIG. 4(B) is a side view of main portions of an antenna apparatus according to a third embodiment.
Figure 4:
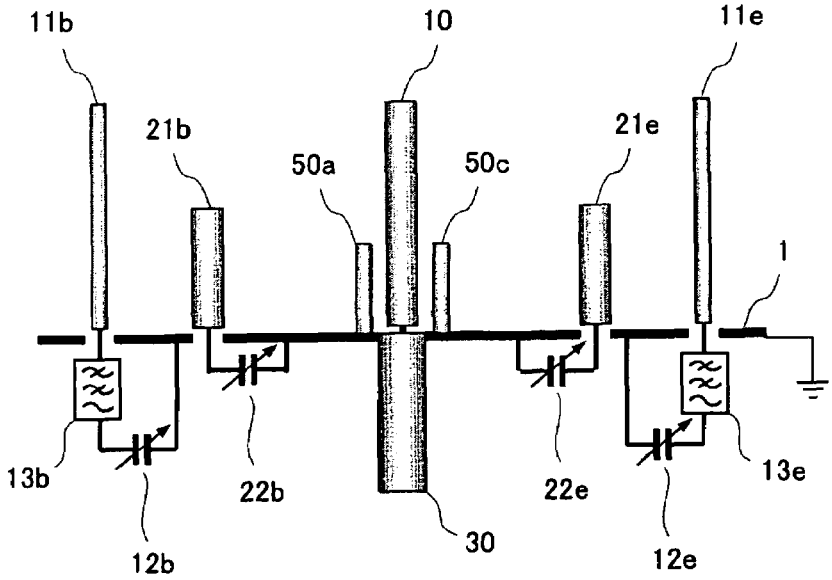

Referring to FIG. 4, an antenna apparatus according to a third embodiment will be described.

In the first embodiment, one monopole antenna serving as a feed element that is excited by the first and second wireless frequency signals is provided as the feed element 10. In the third embodiment, the structure of the antenna apparatus differs from that in the first embodiment in portions regarding the feed element and the first non-feed elements.

Referring to FIG. 4, the monopole-antenna feed element 10 is disposed at the central part of the disc-shaped ground conductor 1, and four matching short-circuit posts 50 are disposed around and near the feed element 10. One ends of the matching short-circuit posts 50 (among the four matching short-circuit posts, three matching short-circuit posts 50*a*, 50*c*, and 50*d* are shown in the drawing) are electrically connected to the ground conductor 1.

Six first non-feed elements 11*a* to 11*f* are circularly disposed around the feed element 10. Filters for passing the first frequency band (2.4 GHz band) and cutting off the second frequency band (5.2 GHz band) are connected to associated ends of the first non-feed elements 11*a* to 11*f*. First variable-reactance circuits are connected between other ends of the filters and the ground. In FIG. 4(B), only the first non-feed elements 11*b* and 11*e* are shown in order to simplify the drawing. Accordingly, only the filters 13*b* and 13*e* connected to the non-feed elements 11*b* and 11*e* and the first variable-reactance circuits 12*b* and 12*e* connected between the other ends of the filters 13*b* and 13*e* and the ground are shown. The other portions of the structure in FIG. 4 are the same as those shown in FIG. 1.

The feed element 10 is a monopole antenna that resonates in the first frequency band (2.4 GHz band), and the matching short-circuit posts 50 are short-circuit posts for adjusting the matching in the second frequency band (5.2 GHz band). When the first wireless frequency signal (a signal in accordance with the IEEE 802.11b/g) in the first frequency band (2.4 GHz band) is supplied from the feeder circuit 30, the feed element 10 is excited by this signal. When the second wireless frequency signal (a signal in accordance with the IEEE 802.11a standard) in the second frequency band (5.2 GHz band) is supplied from the feeder circuit 30, the matching short-circuit posts 50 couple with the feed element 10 and operate as feed elements in the second frequency band. That is, the matching short-circuit posts 50 are excited by this signal. Accordingly, feeding can be performed in a state in which matching is established with respect to the first and second wireless frequency signals.

By controlling the reactances of the second variable-reactance circuits 22 connected to the second non-feed elements 21*a* to 21*f* for higher frequencies, the radiation directivity in the horizontal plane (in the direction of the surface of the ground conductor 1) with respect to the second wireless frequency signal (a signal in the 5.2 GHz band in accordance with the IEEE 802.11a standard) can be controlled. Similarly, by controlling the reactances of the first variable-reactance circuits 12 for lower frequencies, the radiation directivity in the horizontal plane with respect to the first wireless frequency signal (a signal in the 2.4 GHz band in accordance with the IEEE 802.11b/g standards) can be controlled.

Figure 5:
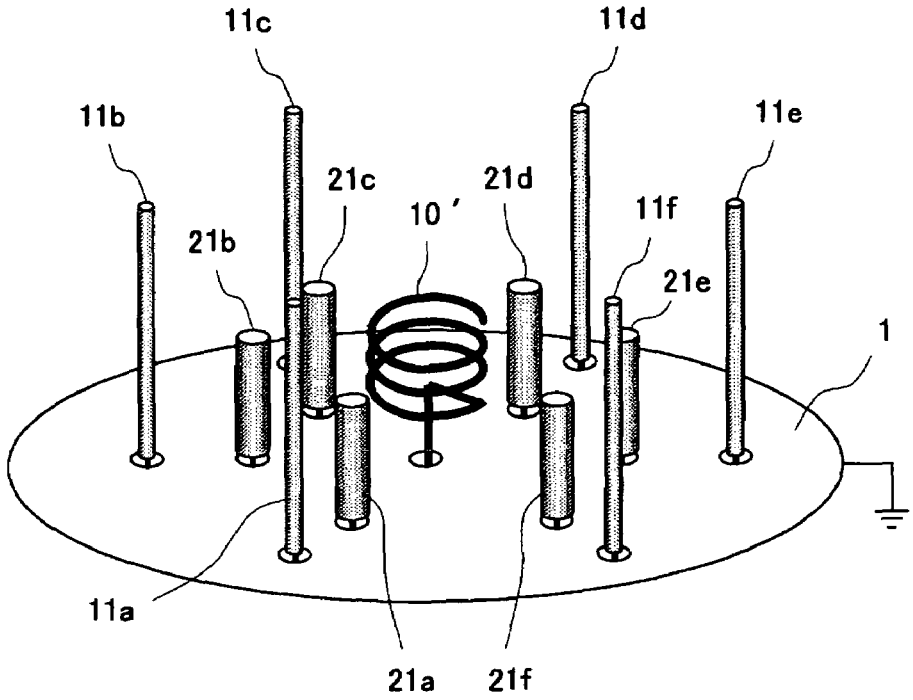
FIG. 5 is a perspective view of main portions of an antenna apparatus according to a fourth embodiment.

Referring to FIG. 5, an antenna apparatus according to a fourth embodiment will be described.

FIG. 5 is a perspective view of main portions of an antenna apparatus. In this example, a feed element 10', which is a helical antenna, is disposed at the central part of the disc-shaped ground conductor 1. With this structure, power can be supplied to the feed element 10' in a state in which matching is established with respect to both the first and second wireless frequency signals. Similar advantages can be achieved by disposing, instead of such a helical antenna, a meandering feed element.

The structure of the feed element is not limited to those shown in FIGS. 1, 2, 4, and 5, and may be any structure so long as the structure can be excited in a plurality of desired frequency bands.

Figure 6:
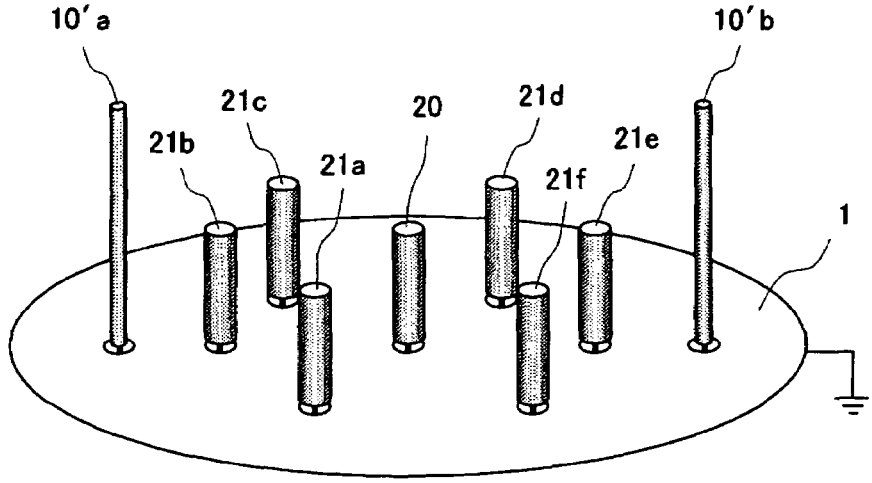
FIG. 6(A) is a perspective view and FIG. 6(B) is a side view of main portions of an antenna apparatus according to a fifth embodiment.
Figure 6:
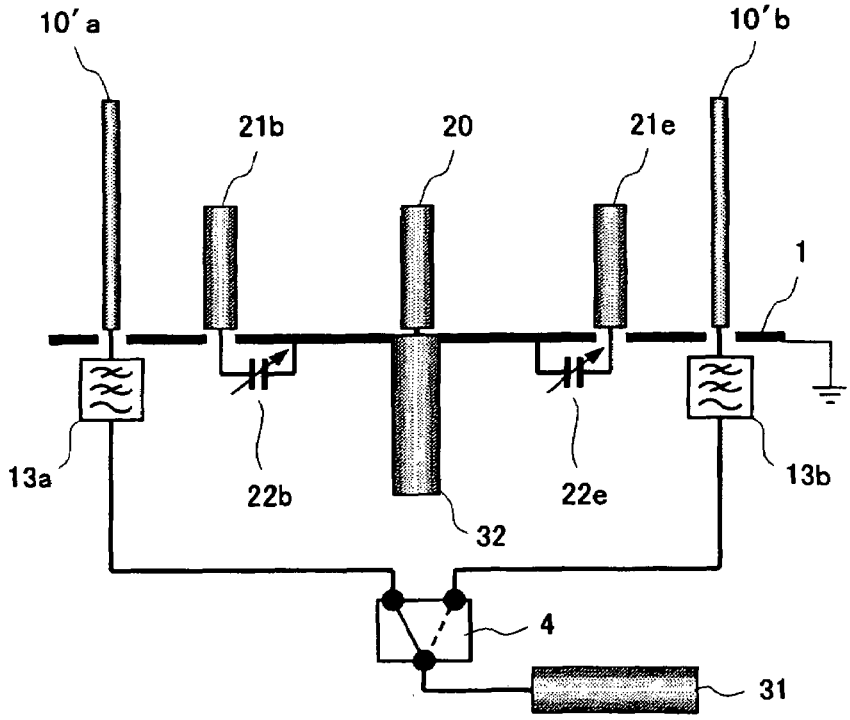
Figure 7:
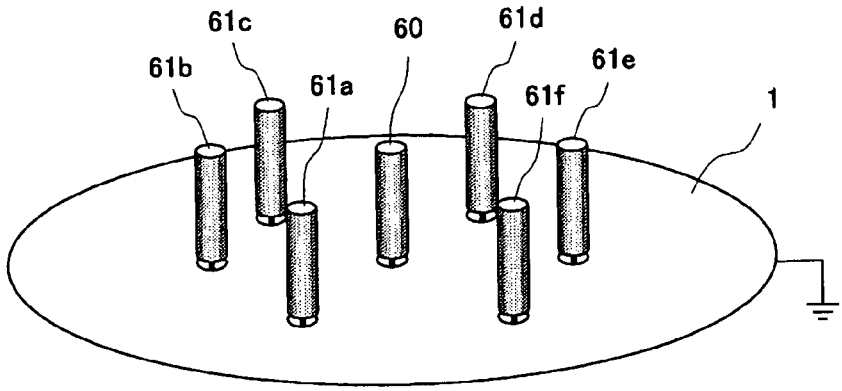
FIG. 7(A) is a perspective view and FIG. 7(B) is a side view of main portions of a known antenna apparatus.
Figure 7:
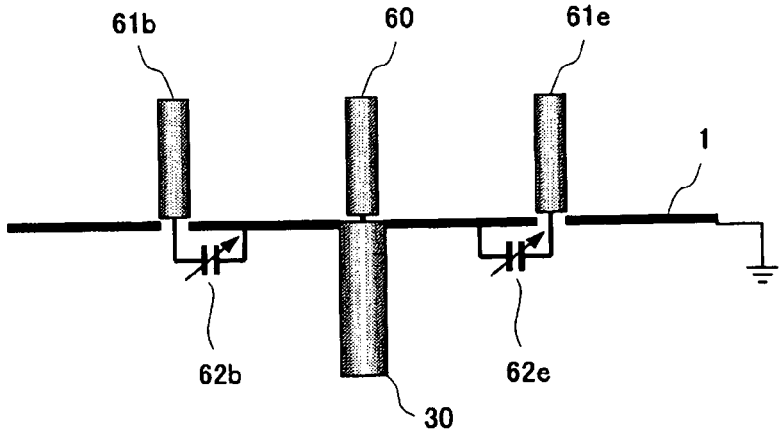

Referring to FIG. 6, an antenna apparatus according to a fifth embodiment will be described.

FIG. 6(A) is a perspective view of main portions of an antenna apparatus, and FIG. 6(B) is a side view of the main portions of the antenna apparatus. First feed elements 10'*a* and 10'*b* are disposed axisymmetrically with respect to the central part of the grounded ground conductor 1. The second feed element 20 is disposed at the central part of the disc-shaped ground conductor 1. The six second non-feed elements 21*a* to 21*f* are circularly disposed equiangularly around the second feed element 20.

As shown in FIG. 6(B), an antenna switching circuit 4 is connected to the first feed elements 10'*a* and 10'*b* via the filters 13*a* and 13*b* for passing the first frequency band (2.4 GHz band) and cutting off the second frequency band (5.2 GHz band). The first feeder circuit 31 is connected to the antenna switching circuit 4. The second feeder circuit 32 is connected to the second feed element 20. The variable-reactance circuits 22 are connected between the second non-feed elements 21*a* to 21*f* and the ground. In FIG. 6(B), only the non-feed elements 21*b* and 21*e* are shown in order to simplify the drawing. Accordingly, only the variable-reactance circuits 22*b* and 22*e* connected between the non-feed elements 21*b* and 21*e* and the ground are shown.

By supplying the second wireless frequency signal from the second feeder circuit 32 and controlling the reactances of the second variable-reactance circuits connected to the second non-feed elements 21*a* to 21*f*, the radiation directivity can be controlled.

With this structure, when the first feeder circuit 31 supplies the first wireless frequency signal, the antenna apparatus operates as a switching diversity antenna with respect to the first wireless frequency signal. More specifically, the antenna switching circuit 4 is operated on the basis of, for example, FER (Frame Error Rate) and RSSI (Received Signal Strength Indicator) at the time of reception, so that the first wireless frequency signal can be received in a most satisfactory state.

Since the first feed elements 10'*a* and 10'*b* are provided with the filters 13*a* and 13*b* for passing the first frequency band and cutting off the second frequency band, there is almost no electromagnetic coupling between the feed elements 10'*a* and 10'*b* and the second non-feed elements 21*a* to 21*f*. Even when the antenna switching circuit 4 is operated, the radiation directivity with respect to the second wireless frequency signal is not affected.

Although the antenna apparatuses in the above-described embodiments have been described mainly as transmitting antennas, it is clear that, by virtue of the reciprocity theorem, similar advantages can be achieved by the antenna apparatuses operating as receiving antennas.

The invention claimed is:

1. An antenna apparatus comprising:

a feed element excited by a first wireless frequency signal in a first frequency band and a second wireless frequency signal in a second frequency band higher than the first frequency band;

a first non-feed element controlling directivity with respect to the first wireless frequency signal;

a second non-feed element controlling directivity with respect to the second wireless frequency signal;

a filter passing the first frequency band and cutting off the second frequency band, a first end of the filter being connected to the first non-feed element;

a first variable-reactance circuit connected between a second end of the filter and a ground; and a second variable-reactance circuit connected between the second non-feed element and the ground.

2. The antenna apparatus according to claim 1, wherein the feed element is disposed in a central part of a disc-shaped ground conductor.

3. The antenna apparatus according to claim 2, wherein the disc-shaped ground conductor includes a skirt portion extending downward from a periphery thereof.

4. The antenna apparatus according to claim 1, wherein the feed element includes a monopole antenna.

5. The antenna apparatus according to claim 1, wherein the first non-feed element is disposed at about one-quarter to one-half wavelength in the first frequency band from the feed element.

6. The antenna apparatus according to claim 1, wherein a plurality of second non-feed elements are circularly disposed around the feed element.

7. The antenna apparatus according to claim 6, wherein the plurality of second non-feed elements are circularly disposed at intervals of 60 degrees, at about one-quarter to one-half wavelength in the second frequency band from the feed element.

8. The antenna apparatus according to claim 1, wherein the first and second variable-reactance circuits each include a variable capacitance element whose reactance changes with applied voltage and a circuit for applying a control voltage to the variable capacitance element.

9. The antenna apparatus according to claim 1, wherein a plurality of first non-feed elements are circularly disposed around the feed element.

10. The antenna apparatus according to claim 1, further comprising at least one short-circuit post disposed near the feed element.

11. The antenna apparatus according to claim 1, wherein the feed element is a helical antenna.

12. An antenna apparatus comprising:

a first feed element excited by a first wireless frequency signal in a first frequency band;

a second feed element excited by a second wireless frequency signal in a second frequency band higher than the first frequency band;

a first non-feed element controlling directivity with respect to the first wireless frequency signal;

a second non-feed element controlling directivity with respect to the second wireless frequency signal;

a filter passing the first frequency band and cutting off the second frequency band, a first end of the filter being connected to the first non-feed element;

a first variable-reactance circuit connected between a second end of the filter and a ground; and a second variable-reactance circuit connected between the second non-feed element and the ground.

13. The antenna apparatus according to claim 12, wherein the first non-feed element is disposed at about one-quarter to one-half wavelength in the first frequency band from the first feed element.

14. The antenna apparatus according to claim 12, wherein a plurality of second non-feed elements are circularly disposed around the second feed element.

15. The antenna apparatus according to claim 14, wherein the plurality of second non-feed elements are circularly disposed at intervals of 60 degrees, at about one-quarter to one-half wavelength in the second frequency band from the second feed element.

16. The antenna apparatus according to claim 12, wherein the first and second variable-reactance circuits each include a variable capacitance element whose reactance changes with applied voltage and a circuit for applying a control voltage to the variable capacitance element.

17. An antenna apparatus comprising:

a plurality of first feed elements excited by a first wireless frequency signal in a first frequency band;

a second feed element excited by a second wireless frequency signal in a second frequency band higher than the first frequency band;

a non-feed element controlling directivity with respect to the second wireless frequency signal;

a variable-reactance circuit connected between the non-feed element and ground;

a filter passing the first frequency band and cutting off the second frequency band, a first end of the filter being connected to the first feed elements; and a switching circuit connected between a second end of the filter and a feeder circuit feeding the first wireless frequency signal.

18. The antenna apparatus according to claim 17, wherein the plurality of first feed elements are axisymmetrically disposed with respect to a central part of a disc-shaped ground conductor.

19. The antenna apparatus according to claim 17, wherein the variable-reactance circuit includes a variable capacitance element whose reactance changes with applied voltage and a circuit for applying a control voltage to the variable capacitance element.

* * * * *